United States Patent [19]

Wunderlich et al.

[11] 4,405,248

[45] Sep. 20, 1983

[54] ADVANCING DEVICE IN ELECTRICALLY DRIVEN TYPEWRITERS AND SIMILAR MACHINES

[75] Inventors: Klaus Wunderlich; Udo Schlegel; Heinz Ricke, all of Brunswick, Fed. Rep. of Germany

[73] Assignee: Olympia Werke AG, Wilhelmshaven, Fed. Rep. of Germany

[21] Appl. No.: 312,154

[22] Filed: Oct. 16, 1981

[30] Foreign Application Priority Data

Oct. 22, 1980 [DE] Fed. Rep. of Germany ..... 3039789

[51] Int. Cl.[3] ..... B41J 11/36; B41J 19/14

[52] U.S. Cl. ..... 400/550; 400/551; 400/568

[58] Field of Search ..... 400/550, 551, 568, 611, 400/485

[56] References Cited

U.S. PATENT DOCUMENTS 2,989,680 6/1961 Weiser et al. ..... 400/154.3

3,618,738 11/1971 Boyatt et al. ..... 400/551

OTHER PUBLICATIONS

IBM Technical Disclosure Bulletin, vol. 22, No. 5, Oct. 1979, pp. 1760–1763.

*Primary Examiner*—Paul T. Sewell

*Attorney, Agent, or Firm*—Spencer & Kaye

[57] ABSTRACT

In an advancing device for the motorized vertical displacement of a record carrier in an electrically driven office machine, which device includes an operating element mounted for movement in either one of two directions from a zero position, and members responsive to movement of the operating element in either one of its two directions for displacing such carrier in a respective vertical direction corresponding to the direction of movement of the operating element, the members are made to be responsive to movement of the operating element in at least one direction from the zero position for advancing the record carrier at a rate which increases as the extent of displacement of the operating element from the zero position increases.

17 Claims, 4 Drawing Figures

ADVANCING DEVICE IN ELECTRICALLY DRIVEN TYPEWRITERS AND SIMILAR MACHINES

BACKGROUND OF THE INVENTION

The present invention relates to an advancing device for the motorized vertical displacement of a record carrier in an electrically drive office machine, such as a typewriter.

Such an advancing device is disclosed in German Offenlegungsschrift [Laid-open Application] No. 2,056,564, and corresponding U.S. Pat. No. 3,618,738. The machine disclosed therein contains four operating elements: a first key provided to actuate an advancing movement in the forward direction; a second key provided to actuate an incremental movement in the reverse direction; a first shifting switch provided for a slow continuous advancing movement; and a second shifting switch provided for a fast continuous advancing movement. Each shifting switch can be shifted from a zero position in either of two opposite directions, a shift in the one direction actuating a forward advancing movement and a shift in the opposite direction actuating a reverse advancing movement of the advancing device.

Such a device enables the operator to accurately position a record carrier line by line in the forward or reverse direction and also to perform longer advancing movements at a faster rate and to quickly perform insertion and removal manipulations of the record carrier. However, due to the multitude of operating elements, this prior art device is difficult to operate so that the operator requires a longer familiarization period and the given functions are not utilized optimally.

SUMMARY OF THE INVENTION

It is an object of the present invention to provide an advancing device of the above-mentioned type which is simple and logical in operation.

The above, and other objects are achieved, in accordance with the invention, in an advancing device for the motorized vertical displacement of a record carrier in an electrically driven office machine, which device includes an operating element mounted for movement in either one of two directions from a zero position, and means responsive to movement of the operating element in either one of its two directions for displacing such carrier in a respective vertical direction corresponding to the direction of movement of the operating element by constructing the means to be responsive to movement of the operating element in at least one direction from the zero position for advancing the record carrier at a rate which increases as the extent of displacement of the operating element from the zero position increases.

A particular advantage of the present invention is that only a single operating element can be provided for different advancing functions, and its mode and direction of operation correspond in a logical manner to the respectively desired advancing movement. Such an advancing device requires no training or retraining period and does not lend itself to operator errors. It will therefore be appreciated by operators.

DESCRIPTION OF THE PREFERRED EMBODIMENTS

Figure 1:
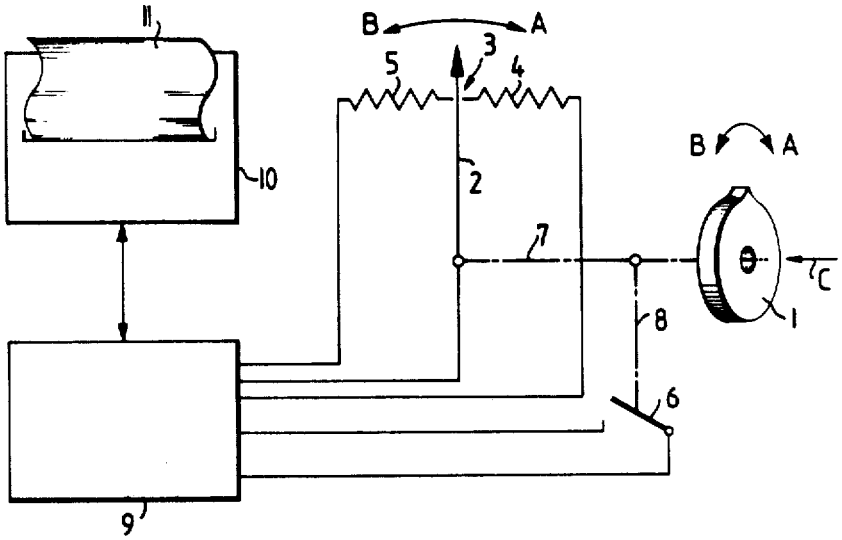
FIGS. 1 and 2 are partly pictorial, partly circuit diagrams of two preferred embodiments of the invention.

FIG. 1 shows a device according to the invention and the associated components of an office machine. An operating element 1 in the form of a hand wheel or thumb wheel is connected to displace the tap 2 of a potentiometer 3 in such a manner that rotation of the hand wheel 1 shifts the tap 2 correspondingly across one of the two resistance paths 4, 5. A second operative connection exists between the wheel 1 and a switch 6 which can be moved from the illustrated open position into a closed position by axially displacing the hand wheel 1. These operative connections, which can be provided according to techniques known to the person skilled in the art, are indicated by chain lines 7 and 8.

The potentiometer 3 and the switch 6 are connected to a machine control 9 which evaluates, inter alia, in an evaluation circuit, the voltage values obtained from the potentiometer 3 so as to control an advancing drive motor in an advancing device 10 for effecting a vertical shift of the record carrier 11.

The evaluation circuit may be, for example, an oscillator circuit whose output frequency is variable depending on the magnitude of the voltage present on the tap 2 and is utilized for the incremental, or step-wise, actuation of the advancing motor. If the voltage value is obtained from the one resistance path 4, there is produced a movement of the advancing device in the forward direction, a voltage value from the other resistance path 5 produces a movement in the reverse direction. The motor for the advancing drive may be a stepping motor as well as an increasingly actuatable direct current or alternating current motor. The switch 6 serves to vary the magnitude of each advancing step. In the open position of the switch 6 the record carrier 11 is moved, for example 1/12 inch per step while in the closed position of the switch, the size of a step is, for example 1/60 inch.

When the hand wheel 1 is pivoted in the direction of the arrow A from the illustrated zero position, the record carrier 11 is thus transported forward in increments. If the pivoting is only slight, the individual steps are spaced apart by relatively long time intervals, whereas with an increasing pivot angle, these intervals continue to become smaller until, with the maximum pivoting, finally, the steps follow one another so closely that they correspond to a rapid continuous advance. When the hand wheel 1 is rotated in the direction of the arrow B from the zero position, the described advancing function is performed in the reverse direction.

If the hand wheel 1 is displaced along its axis in the direction of arrow C, before or during rotation, switch 6 is closed so that the described forward or reverse shifting function is performed in smaller incremental steps.

Figure 3:
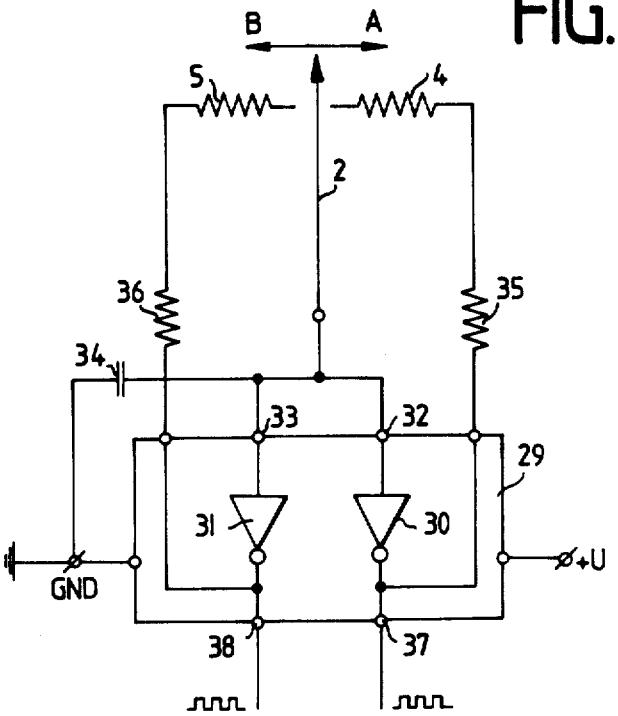
FIG. 3 is a circuit diagram of one embodiment of a portion of the circuit of FIG. 1.

One example of the evaluation circuit of the machine control 9 is the double oscillator shown in FIG. 3. A commercially available integrated circuit 29, e.g. made according to the CMOS technique, essentially comprises two Schmitt trigger inverters 30 and 31 and is connected between operating voltage terminals +U and GND. The tap 2 of potentiometer 3 is connected to the two input terminals 32 and 33 of the Schmitt trigger inverters 30 and 31 and, via a capacitor 34, to GND. Between the output of each of the Schmitt trigger inverters 30 and 31 and a respective resistance path 4 or 5, there is disposed a respective one of the resistors 35 and 36, which, in order to provide better tuning, may also be adjustable.

In the rest, or center, position of the tap 2 neither of the two return branches is closed so that the two outputs 37 and 38 of the circuit 29 remain in their static, or D.C. voltage, state. As soon as one of the two return branches is closed by moving the tap 2 in the direction A or B, the respective Schmitt trigger inverter 30 or 31 will begin to oscillate so that square wave pulses are emitted at the output 37 or 38. The frequency of these pulses is determined by the values of capacitor 34, resistor 35 or 36, respectively, and resistance path 4 or 5, respectively of the potentiometer3; a shift in the position of tap 2 brings about a corresponding change in the respective frequency.

The output 37 associated with the forward shifting direction and the output 38 associated with the reverse shifting direction are connected, for further evaluation, to a microprocessor, not shown in detail, which causes the advancing drive motor of the advancing device 10 to be actuated. The described oscillator circuit is here of particular advantage because the pulse trains at the outputs 37 and 38 have a keying, or on/off, ratio equal to 1 at every frequency, which enables the microprocessor to make a simple and time saving evaluation. Each pulse, however, produces a record carrier movement step of fixed length.

Figure 2:
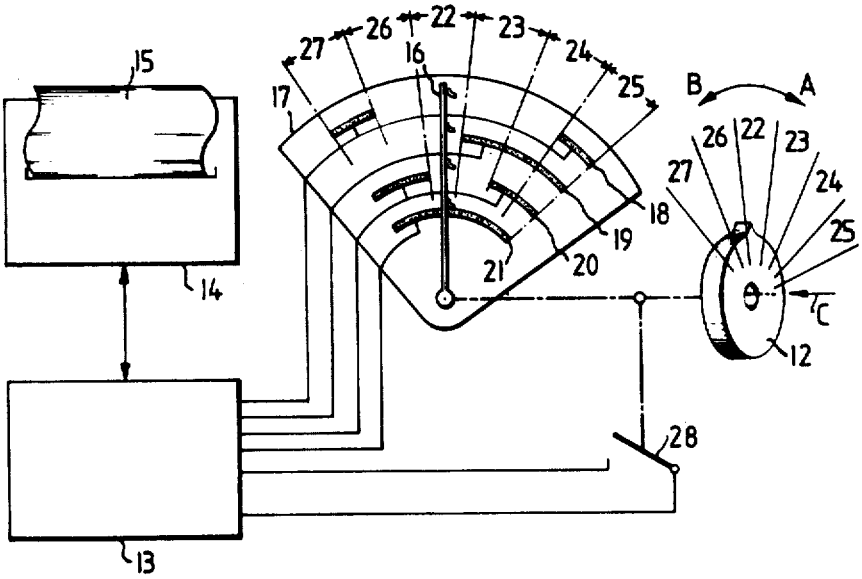

Another embodiment is shown in FIG. 2. It again includes a rotatable and axially displaceable hand wheel 12, a machine control 13 and an advancing device 14 for vertically displacing a record carrier 15, but instead of the potentiometer of FIG. 1 there is provided a code path carrier 17 which is sensed by a pickup 16. Four contact paths 18, 19, 20 and 21 are provided with defined contact regions arranged to be in contact with respective ones of four brushes of the pickup 16. An input signal is provided via the inner contact path 21 and the three outer contact paths 18, 19 and 20 provide a code constituted of three on-off (L,O) signals corresponding to the paths in which brushes are contacting contact regions in the present angular position of the pickup and this code is fed to the machine control 13. The signal provided by path 19 designates the carrier displacement direction.

In the position shown in FIG. 2, the hand wheel 12 as well as the pickup 16 take on the zero position and the code LLL is given to the machine control (e.g. a microprocessor) so as to cause the advancing drive to stop. By rotating the hand wheel 1 from the zero position region 22 in the direction of the arrow A, the code LOL is emitted upon entry into the region 23, which effects a slow incremental advance in the forward direction. In the next region 24, a faster advance is effected upon emission of the code LOO, and in the last region 25, where the code OOO is produced a particularly fast advance is performed which is intended particularly for insertion and ejection of the record carrier.

Rotation of the hand wheel 12 in the direction B results, in the first region 26, in scanning the code LLO which causes a slow incremental reverse displacement and in the next region 27, scanning of the code OLO produces a fast reverse shift.

The microprocessor of the machine control 13 includes a central processing unit, memory, an internal clock and several output registers, as well known in the art. It converts the codes obtained from the code path carrier 17 into impulses for the control of the velocity and direction of rotation of the advancing drive motor of advancing device 14 and therefor contains several program routines in its memory, each provided for one of the motor velocities and direction of rotation and each being addressable by respective ones of the codes from code path carrier 17. The advancing drive motor is assumed to be a stepping motor with four coils being connected with a motor decoder via four lines. Changing of the voltage signals on those lines causes the motor to rotate in a step-by-step fashion in forward or reverse direction in accordance with a predetermined sequence of voltage signals.

An addressed program routine causes the microprocessor to deliver impulses to a first one of its output registers in a frequency corresponding to the predetermined motor velocity and an information regarding the direction of rotation to a second one of its output registers. The output registers are connected with the motor decoder, which operates in response to the impulses from the first output register and to the information from the second output register to change the energization scheme of the coils of the advancing motor from one step to the next in a sequence corresponding to the frequency of the impulses, and in a direction dictated by the information.

Several ways of utilizing microprocessors for motor speed and direction control are well known and therefore the above description is sufficient for a person skilled in the art to realize the circuit and the programming of an appropriate machine control 13.

The pivotal movement of hand wheel 12 is here subdivided into different regions associated with the different speeds so that the change in the speed of the advancing movement is incremental, in contradistinction to the embodiment of FIG. 1 where the change in speed occurs without steps. However, in each embodiment one region is provided for the zero position.

Shifting the hand wheel 12 in the direction of arrow C closes a switch 28, to produce a change in the step size, as already explained in detail with reference to FIG. 1.

Figure 4:
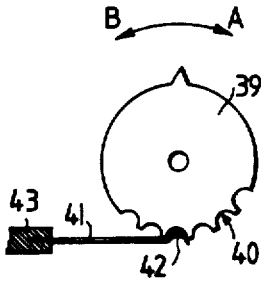
FIG. 4 is a schematic representation of an operating element.

FIG. 4 shows a rotatable hand wheel 39 for another embodiment of the invention with an arrangement of notches 40 along the lower part of its periphery, each of which is associated with a different advancing speed and/or displacement direction. A spring 41 with a protrusion 42 on one end is fastened with its other end to the machine frame 43. In FIG. 4 the hand wheel 39 is locked in the zero position by the protrusion 42. By rotating the hand wheel 39 in the direction of arrow A three further notches will come into contact with the protrusion 42, the first of which corresponds to a slow incremental advance in the forward direction, the second to a faster advance in the forward direction and the third to an advance speed for insertion and ejection of the record carrier. By rotating the hand wheel 39 from the zero position in the direction of arrow B two further notches will come into contact with the protrusion 42, the first of which corresponds to a slow incremental reverse displacement of the record carrier and the second to a fast reverse shift.

In addition to the above-described embodiments, numerous variations are possible within the scope of the present invention, for example a combination of stepped and continuous advancing speeds upon displacement of the operating element, or a different design for the operating element.

It will be understood that the above description of the present invention is susceptible to various modifications, changes and adaptations, and the same are intended to be comprehended within the meaning and range of equivalents of the appended claims.

What is claimed is:

1. In an advancing device for the motorized vertical forward or reverse movement of a record carrier in an electrically driven office machine, which device includes an operating element mounted for displacement in either one of two directions from a zero position, and means responsive to displacement of the operating element in a first one of the two directions for effecting forward vertical movement of such carrier and responsive to displacement of the operating element in the second one of the two directions for effecting reverse vertical movement of such carrier, the improvement wherein said means are responsive to displacement of said operating element in the first direction to at least three successive distances from the zero position for moving the record carrier at a rate which increases between at least three values which increase successively from one value to the next as the extent of displacement of said operating element from the zero position increases from one successive distance to the next, with each successive distance being associated with a respective one of the three rate values.

2. A device as defined in claim 1 wherein said means operate to effect forward movement of the record carrier in discrete steps at spaced time intervals at a rate which increases with increasing displacement of said operating element in the first direction from the zero position, and effects reverse movement of the record carrier in discrete steps at spaced time intervals in response to displacement of said operating element in the second direction from the zero position.

3. A device as defined in claim 1 wherein said means operate to effect a first forward movement of the record carrier in discrete steps at spaced time intervals in response to displacement of said operating element in the first direction over a first distance from the zero position, and a continuous forward movement at a higher rate than the first movement in response to displacement of said operating element in the first direction to a distance from the zero position which is greater than the first distance.

4. A device as defined in claim 1 wherein said means operate to effect a first forward movement of the record carrier in discrete steps at spaced time intervals in response to displacement of said operating element in the first direction to a first distance from the zero position, and a second forward movement at a rate which increases with increasing displacement of said operating element from the zero position over a displacement path which is more remote from the zero position than the first distance.

5. A device as defined in claim 1, 2, 3 or 4 wherein said means operate to effect reverse movement of said record carrier at a rate which increases as the extent of displacement of said operating element in the second direction from the zero position increases.

6. A device as defined in claim 5 wherein said operating element is constructed to be displaceable in at least one direction from the zero position over a path composed of a plurality of segments each associated with a respective record carrier movement rate.

7. A device as defined in claim 5 wherein said operating element is constructed to be displaceable in at least one direction from the zero position over a path presenting a plurality of successive detent points each associated with a respective rate of movement from the record carrier.

8. A device as defined in claim 1, 2, 3 or 4 wherein said means operate to effect a first reverse movement of said record carrier in discrete steps at spaced time intervals in response to displacement of said operating element in the second direction over a first distance from the zero position, and a continuous reverse movement at a higher rate than the first movement in response to displacement of said operating element in the second direction to a distance from the zero position which is greater than the first distance.

9. A device as defined in claim 1, 2, 3 or 4 wherein said means operate to effect a first reverse movement of said record carrier in discrete steps at spaced time intervals in response to displacement of said operating element in the second direction over a first distance from the zero position, and a second reverse movement at said rate which increases as the extent of displacement of said operating element increases in the second direction from the zero position beyond the first distance.

10. A device as defined in claim 1 or 2 wherein said operating element is constructed to be displaceable in at least one direction from the zero position over a path composed of a plurality of segments each associated with a respective record carrier movement rate.

11. A device as defined in claim 1 or 2 wherein said operating element is constructed to be displaceable in at least one direction from the zero position over a path presenting a plurality of successive detent points each associated with a respective rate of movement from the record carrier.

12. A device as defined in claim 1, 2, 3 or 4 wherein the zero position coincides with a predetermined displacement range of said operating element.

13. A device as defined in claim 1, 2, 3 or 4 wherein said means comprise: a position transducer connected to be displaced with said operating element for producing an output signal representative of the position of said operating element relative to the zero position; and an evaluation circuit connected to receive the output signal provided by said transducer and to move the record carrier in response thereto.

14. A device as defined in claim 13 wherein said transducer comprises a potentiometer.

15. A device as defined in claim 13 wherein said transducer comprises means fixed relative to said operating element and defining a path presenting spaced code signal emitters, and a pickup movable with said operating element along said path.

16. A device as defined in claim 2, 3 or 4 further comprising a manually actuatable switch connected for varying the magnitude of each discrete step of movement of the record carrier.

17. A device as defined in claim 16 wherein said switch is connected to be actuated by displacement of said operating element in a direction other than the first-recited two directions of displacement.

* * * * *